US005364755A

United States Patent [19]

Miyamoto et al.

[11] Patent Number: 5,364,755

[45] Date of Patent: * Nov. 15, 1994

[54] SILVER HALIDE PHOTOGRAPHIC LIGHT-SENSITIVE MATERIAL

[75] Inventors: Yasushi Miyamoto; Akihiko Ikegawa, both of Minami-ashigara, Japan

[73] Assignee: Fuji Photo Film Co., Ltd., Kanagawa, Japan

[ * ] Notice: The portion of the term of this patent subsequent to Mar. 1, 2011 has been disclaimed.

[21] Appl. No.: 47,496

[22] Filed: Apr. 16, 1993

[30] Foreign Application Priority Data

Apr. 17, 1992 [JP] Japan ..... 4-122971

[51] Int. Cl.[5] ..... G03C 1/09; G03C 1/16; G03C 1/18

[52] U.S. Cl. ..... 430/584; 430/588; 430/601; 430/603

[58] Field of Search ..... 430/575, 584, 588, 603, 430/601

[56] References Cited

U.S. PATENT DOCUMENTS

| | | | |
|---|---|---|---|
| 3,264,110 | 8/1966 | Depoorter et al. | 430/584 |
| 3,282,933 | 11/1966 | Nys et al. | 430/584 |
| 3,615,634 | 10/1971 | Götze et al. | 430/588 |
| 4,118,228 | 10/1978 | Corluy et al. | 430/588 |
| 4,524,728 | 6/1985 | Edwards et al. | 430/584 |
| 5,114,838 | 5/1992 | Yamada | 430/603 |

FOREIGN PATENT DOCUMENTS

| | | | |
|---|---|---|---|
| 0122125 | 4/1984 | European Pat. Off. | G03C 1/06 |
| 428041 | 5/1991 | European Pat. Off. | 430/603 |
| 454069 | 10/1991 | European Pat. Off. | 430/603 |
| 980234 | 1/1965 | United Kingdom | 430/584 |

*Primary Examiner*—Janet C. Baxter
*Attorney, Agent, or Firm*—Sughrue, Mion, Zinn, Macpeak & Seas

[57] ABSTRACT

A silver halide photographic light-sensitive material have at least one silver halide emulsion layer on a support, wherein at least one of the silver halide emulsion layers comprises an emulsion subjected to chemical sensitization with a selenium compound and spectral sensitization with at least one type of a methine compound represented by Formula (I) below:

Formula (I)

wherein $R^1$ represents $-(CH_2)_r-CONHSO_2-R_3$, $-(CH_2)_s-SO_2NHCO-R^4$, $-(CH_2)_t-CONHCO-R^5$, or $-(CH_2)_u-SO_2NHSO_2-R^6$; $R^3$, $R^4$, $R^5$, and $R^6$ each represent an alkyl group, an alkoxy group, or an amino group; $R^2$ has the same meaning as $R^1$ or represents an alkyl group; $Z^1$ and $Z^2$ each represent a nonmetal atom group required to form a 5- or 6-membered heterocyclic ring; each of $L_1$, $L_2$, and $L_3$ represents a methine group; $X_1$ represents anion; r, s, t, and u each represent an integer from 1 to 5; each of p and q represents 0 or 1; m represents 0, 1, or 2; and k represents a number required to adjust the charge in the molecule to 0.

7 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material with a high sensitivity and a high storage stability.

2. Description of the Related Art

It is common practice to perform chemical sensitization using various chemical substances for silver halide emulsions for use in silver halide photographic light-sensitive materials in order to obtain, e.g., desired sensitivities and gradations. Representative known examples of the sensitization are sulfur sensitization, selenium sensitization, noble metal sensitization such as gold sensitization, reduction sensitization, and various sensitization methods using combinations of these sensitization methods.

Among these sensitization methods, the selenium sensitization has attracted attention as a sensitization method suitable for increasing the sensitivity of a silver halide emulsion because its sensitizing effect is larger than that of the sulfur sensitization normally performed in this field of art. Methods of the selenium sensitization are disclosed in, e.g., U.S. Pat. Nos. 1,574,944, 1,602,592, 1,623,499, 3,297,446, 3,297,447, 3,320,069, 3,408,196, 3,408,197, 3,442,653, 3,420,670, and 3,591,385, French Patents 2,693,038 and 2,093,209, JP-B-52-34491 ("JP-B" means Published Examined Japanese Patent Application), JP-B-52-34492, JP-B-53-295, JP-B-57-22090, JP-A-59-180536 ("JP-A" means Published Unexamined Japanese Patent Application), JP-A-59-181337, JP-A-59-187338, JP-A-59-192241, JP-A-60-150046, JP-A-60-151637, JP-A-61-246738, JP-A-3-4221, JP-A-3-148648, JP-A-1-250950, JP-A-1-254441, JP-A-2-34090, JP-A-2-110558, JP-A-2-130976, JP-A-2-139183, JP-A-2-229300, British Patents 255,846 and 861,984, and H. E. Spencer et al., Journal of Photographic Science, Vol. 31, pages 158 to 169 (1983).

The selenium sensitization, however, has a problem of a significant increase in fog during storage from the manufacture to the use of a light-sensitive material, although it generally has a great sensitizing effect.

A method of solving this problem of the selenium sensitization is disclosed in, e.g., EP0122125A1, in which it is assumed that the above drawback is improved by performing the selenium sensitization together with spectral sensitization using a certain kind of a cyanine dye for a monodisperse silver halide emulsion. However, this method is still unsatisfactory to eliminate the above problem.

SUMMARY OF THE INVENTION

It is an object of the present invention to provide a silver halide photographic light-sensitive material with a high sensitivity and a high storage stability.

The above object of the present invention is achieved by the silver halide photographic light-sensitive materials described in items (1) to (6) below:

(1) A silver halide photographic light-sensitive material having at least one silver halide emulsion layer on a support, wherein at least one of the silver halide emulsion layers comprises an emulsion chemically sensitized with a selenium compound, and the emulsion is spectrally sensitized with at least one type of a methine compound represented by Formula (I) below:

Formula (I)

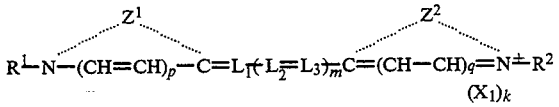

wherein $R^1$ represents $-(CH_2)_r-CONHSO_2-R^3$, $-(CH_2)_s-SO_2NHCO-R^4$, $-(CH_2)_t-CONHCO-R^5$, or $-(CH_2)_u-SO_2NHSO_2-R^6$ wherein $R^3$, $R^4$, $R^5$, and $R^6$ each represent an alkyl group, an alkoxy group, or an amino group, and r, s, t, and u each represent an integer from 1 to 5. $R^2$ has the same meaning as $R^1$ or represents an alkyl group. $Z^1$ and $Z^2$ each represent a nonmetalic atom group required to form a 5- or 6-membered heterocyclic ring, and p and q each represent 0 or 1. $L_1$, $L_2$, and $L_3$ each represent a methine group, and m represents 0, 1, or 2. $X_1$ represents anion, and k represents a number required to adjust the charge in the molecule to 0.

(2) The material described in item (1) above, wherein the heterocyclic ring formed with $Z^1$ and the heterocyclic ring formed with $Z^2$ are both benzothiazole.

(3) The material described in item (1) above, wherein at least one of $L_1$, $L_2$ and $L_3$ represents a methine group substituted by an ethyl group.

(4) The material described in item (1) above, wherein the selenium compound is represented by Formula (A) below:

Formula (A)

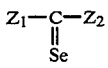

wherein $Z_1$ represents alkyl, aryl or $-NR_1(R_2)$, $Z_2$ represents $-NR_5(R_6)$, and $R_1$, $R_2$, $R_5$ and $R_6$ each represent a hydrogen, alkyl, aryl or acyl.

( 5) The material described in item ( 1) above, wherein the selenium compound is represented by Formula (B) below:

Formula (B)

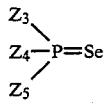

wherein $Z_3$, $Z_4$ and $Z_5$ each represent aliphatic group, an aromatic group or $-OR_7$, and $R_7$ represents an aliphatic group or an aromatic group.

(6) The material described in item (1) above, wherein in the chemical sensitization with selenium compound, a sulfur sensitizer and/or a gold sensitizer are used together.

DETAILED DESCRIPTION OF THE INVENTION

A methine compound represented by Formula (I) will be described in detail below.

An alkyl group represented by $R^3$, $R^4$, $R^5$, or $R^6$ may have a substituent, preferably has four or less carbon atoms, and is most preferably methyl, ethyl, hydroxyalkyl, or aminoethyl. An alkoxy group represented by $R^3$, $R^4$, $R^5$, or $R^6$ may have a substituent, preferably has four or less carbon atoms, and is most preferably methoxy, ethoxy, methoxyethoxy, or hydroxyethoxy. An amino group represented by $R^3$, $R^4$, $R^5$, or $R^6$ may have a substituent, such as an alkyl group, a hydroxyalkyl group, and an alkoxyalkyl group. These substituents may combine to form a ring and preferably have eight or less carbon atoms. An amino group represented by $R^3$, $R^4$, $R^5$, or $R^6$ is most preferably methylamino, dimethylamino, ethylamino, diethylamino, hydroxyethylamino, morpholino, or pyrrolidino. An alkyl group represented by $R^2$ may have a substituent, preferably has five or less carbon atoms, and is most preferably 2-sulfoethyl, 3-sulfopropyl, 4-sulfobutyl, or 3-sulfobutyl. r, s, t, and u each represents 1, 2, or 3.

Examples of the 5- or 6-membered heterocyclic nucleus formed by a nonmetal atom group represented by $Z^1$ or $Z^2$ are a thiazole nucleus {a thiazole nucleus (e.g., thiazole, 4-methylthiazole, 4-phenylthiazole, 4,5-dimethylthiazole, and 4,5-diphenylthiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydroxybenzothiazole, and 4-phenylbenzothiazole), and a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole)}, thiazoline nucleus (e.g., thiazoline, 4-methylthiazoline, and 4-nitrothiazoline), an oxazole nucleus (an oxazole nucleus (e.g., oxazole, 4-methyloxazole, 4-nitrooxazole, 5-methyloxazole, 4-phenyloxazole, 4,5-diphenyloxazole, and 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), and a naphthoxazole nucleus (e.g., naphtho[2,1-d]oxazole, naphtho[1,2-d]oxazole, naphtho[2,3-d]oxazole, and 5-nitronaphtho[2,1-d]oxazole)}, an oxazoline nucleus (e.g., 4,4-dimethyloxazoline), a selenazole nucleus {a selenazole nucleus (e.g., 4-methylselenazole, 4-nitroselenazole, and 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole), and a naphthoselenazole nucleus (e.g., naphtho[2,1-d]selenazole and naphtho[1,2-d]selenazole}, a selenazoline nucleus (e.g., selenazoline and 4-methylselenazoline), a tellurazole nucleus {a tellurazole nucleus (e.g., tellurazole, 4-methyltellurazole, and 4-phenyltellurazole), a benzotellurazole nucleus (e.g., benzotellurazole, 5-chlorobenzotellurazole, 5-methylbenzotellurazole, 5,6-dimethylbenzotellurazole, and 6-methoxybenzotellurazole), and a naphthotellurazole nucleus (e.g., naphtho[2,1-d]tellurazole and naphtho[1,2-d]tellurazole)}, a tellurazoline nucleus (e.g., tellurazoline and 4-methyltellurazoline), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine), an imidazole nucleus {an imidazole nucleus (e.g., 1-alkylimidazole, 1-alkyl-4-phenylimidazole, and 1-arylimidazole), a benzoimidazole nucleus (e.g., 1-alkylbenzoimidazole, 1-alkyl-5-chlorobenzoimidazole, 1-alkyl-5,6-dichlorobenzoimidazole, 1-alkyl-5-methoxybenzoimidazole, 1-alkyl-5-cyanobenzoimidazole, 1-alkyl-5-fluorobenzoimidazole, 1-alkyl-5-trifluoromethylbenzoimidazole, 1-alkyl-6-chloro-5-cyanobenzoimidazole, 1-alkyl-6-chloro-5-trifluoromethylbenzoimidazole, 1-allyl-5,6-dichorobenzoimidazole, 1-allyl-5-chlorobenzoimidazole, 1-arylbenzoimidazole, 1-aryl-5-chlorobenzoimidazole, 1-aryl-5,6-dichlorobenzoimidazole, 1-aryl-5-methoxybenzoimidazole, and 1-aryl-5-cyanobenzoimidazole), and a naphthoimidazole nucleus (e.g., alkylnaphtho[1,2-d]imidazole and 1-arylnaphtho[1,2-d]imidazole); the above alkyl group is preferably a group having one to eight carbon atoms, e.g., a nonsubstituted alkyl group, such as methyl, ethyl, propyl, isopropyl, or butyl, or a hydroxyalkyl group (e.g., 2-hydroxyethyl and 3-hydroxypropyl), and most preferably methyl or ethyl, and the above aryl group represents phenyl, halogen (e.g., chlorine)-substituted phenyl, alkyl(e.g., methyl)-substituted phenyl, or an alkoxy(e.g., methoxy)-substituted phenyl), a pyridine nucleus (e.g., 2-pyridine, 4-pyridine, 5-methyl-2-pyridine, and 3-methyl-4-pyridine), a quinoline nucleus {a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline), and an isoquinoline nucleus (e.g., 6-nitro-1-isoquinoline, 3,4-dihydro-1-isoquinoline, and 6-nitro-3-isoquinoline)}, an imidazo[4,5-b]quinoxaline nucleus (e.g., 1,3-diethylimidazo[4,5-b]quinoxaline and 6-chloro-l,3-diallylimidazo[4,5-b]quinoxaline), an oxadiazole nucleus, a thiazole nucleus, a tetrazole nucleus, and a pyrimidine nucleus.

Among these heterocyclic nuclei, preferable nuclei are a thiazole nucleus, a benzothiazole nucleus, a naphthothiazole nucleus, an oxazole nucleus, a benzoxazole nucleus, a naphthoxazole nucleus, a benzoselenazole nucleus, a benzoimidazole nucleus, a naphthoimidazole nucleus, and a quinoline nucleus, and most preferable nuclei are a benzothiazole nucleus, a benzoselenazole nucleus, and a quinoline nucleus.

It is preferable that the heterocyclic ring formed with $Z^1$ and the heterocyclic ring formed with $Z^2$ are both benzothiazole.

A methine group represented by $L_1$, $L_2$, or $L_3$ may have a substituent. Examples of the substituent are an alkyl group (e.g., methyl, ethyl, and 2-carboxyethyl) which may have a substituent, an aryl group (e.g., phenyl and o-carboxyphenyl) which may have a substituent, a halogen atom (e.g., chlorine and bromine), an alkoxy group (e.g., methoxy and ethoxy), and an alkylthio group (e.g., methylthio and ethylthio). This methine group may also form a ring together with another methine group or with an auxochrome.

It it preferable that at least one of $L_1$, $L_2$ and $L_3$ represents a methine group substituted by an ethyl group.

Examples of anion represented by $X_1$ are inorganic acid and organic acid anions (e.g., chloride, bromide, iodide, p-toluenesulfonate, naphthalenedisulfonate, methanesulfonate, methylsulfate, ethylsulfate, and perchlorate).

m is preferably 0 or 1.

Practical examples of a methine compound represented by Formula (I) are presented below, but the present invention is not limited to these examples.

I-1

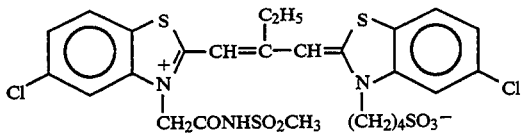

I-2

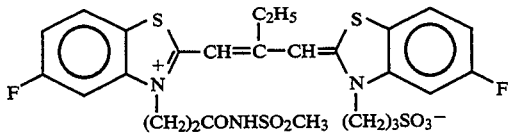

I-3

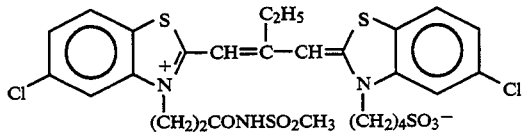

I-4

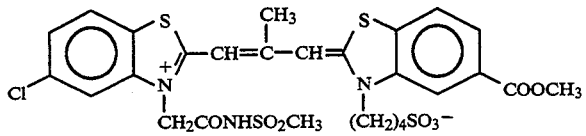

I-5

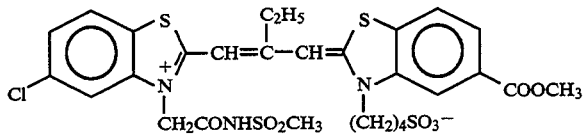

I-6

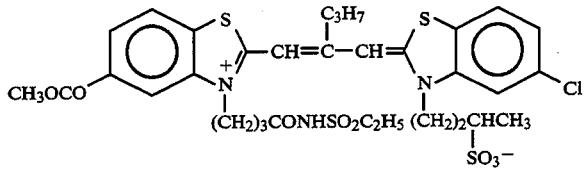

I-7

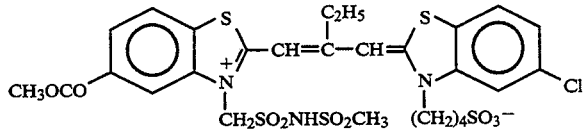

I-8

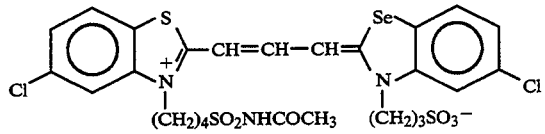

I-9

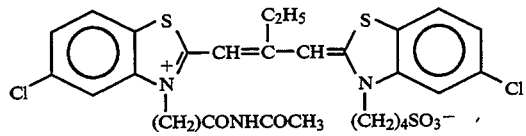

-continued
I-10
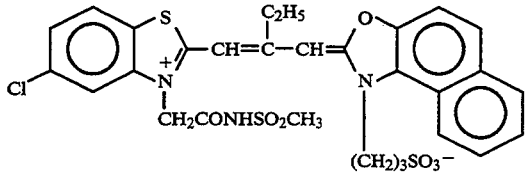
I-11
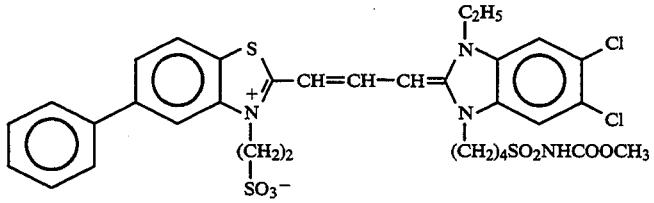
I-12
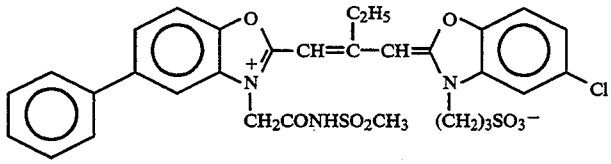
I-13
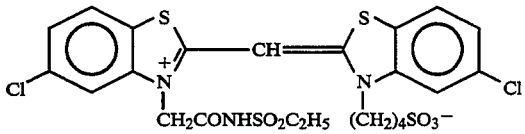
I-14
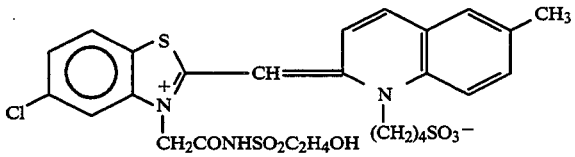
I-15
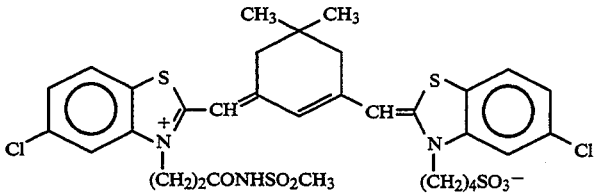
I-16
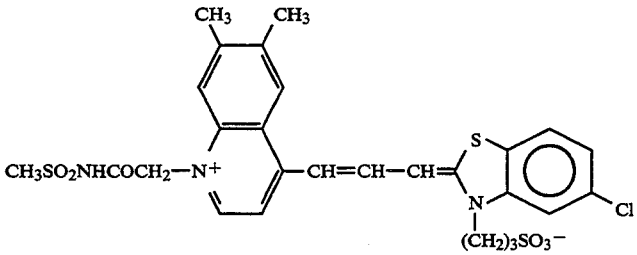
I-17
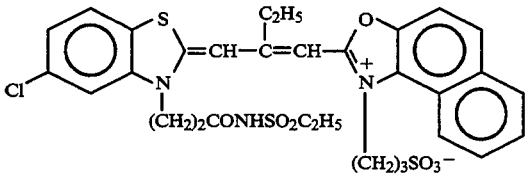

-continued
I-18
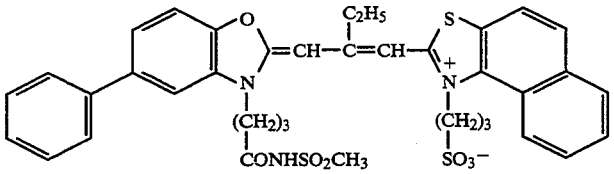
I-19
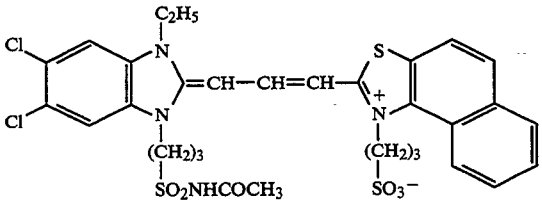
I-20
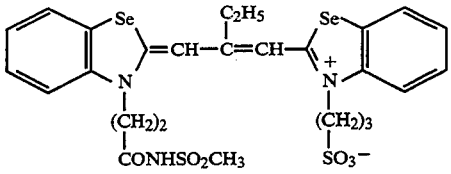
I-21
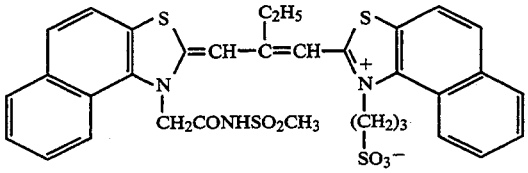
I-22
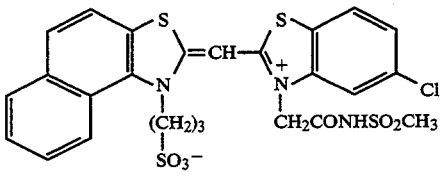
I-23
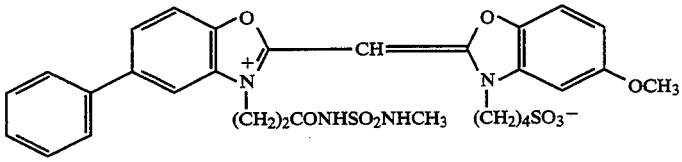
I-24
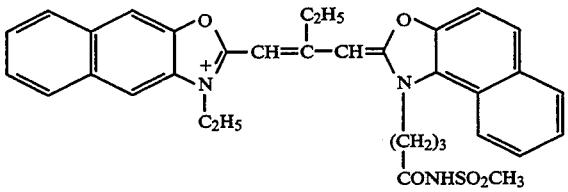
I-25
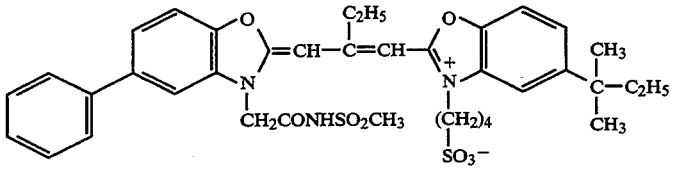

-continued

I-26

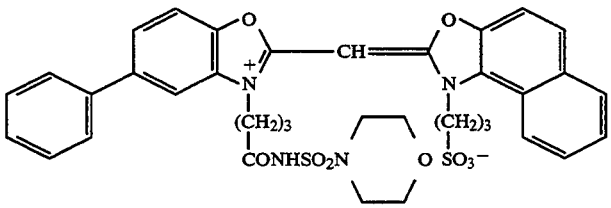

I-27

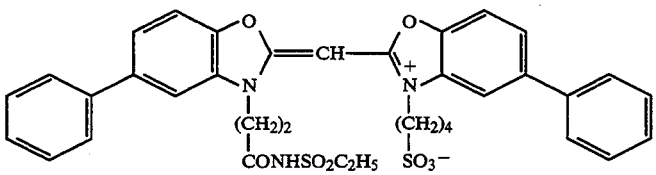

I-28

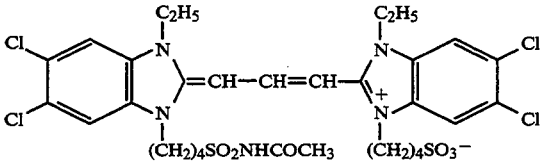

I-29

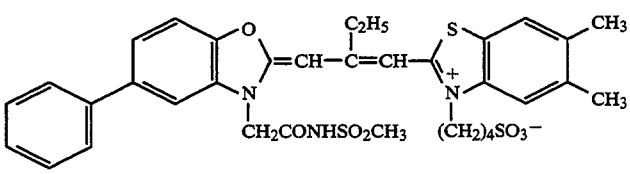

I-30

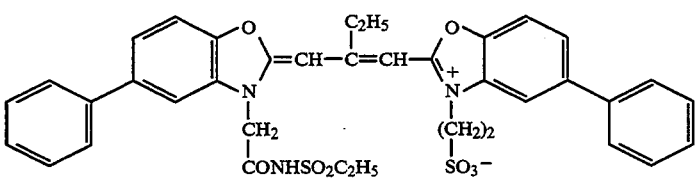

I-31

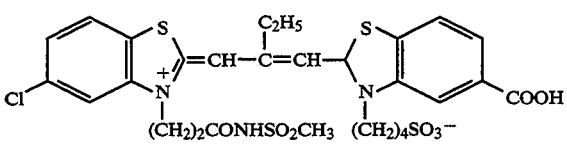

I-32

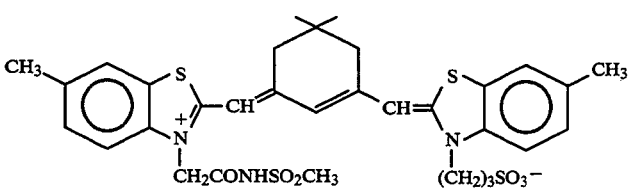

Photographic emulsions used in the present invention may be subjected to spectral sensitization by using, e.g., other methine dyes in addition to compounds represented by Formula (I) above. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. These nuclei may be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although compounds represented by Formula (I) may be used singly, they can also be used together with other sensitizers. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,603,377, 3,769,301, 3,814,609, 3,837,862, and 4,026,707, British Patents 1,344,281 and 1,507,803, JP-B-43-49336, JP-B-53-12375, JP-A-52-110618, and JP-A-52-109925.

Emulsions may contain, in addition to compounds represented by Formula (I), dyes having no spectral sensitizing effect or substances not essentially absorbing visible light and presenting supersensitization.

Methine compounds represented by Formula (I) can be dissolved in a known organic solvent, such as methanol or ethanol, and added in the form of a solution. These compounds can also be added in the form of an aqueous solution or a gelatin dispersion.

Compounds represented by Formula (I) can be added to an emulsion at any timing in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount may be $4\times10^{-6}$ to $8\times10^{-3}$ mole per mole of a silver halide. However, for a more preferable silver halide grain size of 0.2 to 1.2 μm, an addition amount of about $5\times10^{-5}$ to $2\times10^{-3}$ mole is more effective.

Methine compounds represented by Formula (I) can achieve the effect of the present invention in any layer of a light-sensitive material to which they are added so long as a silver halide emulsion is contained in that layer. Preferable examples of the layer are underlying layers (layers closer to a base).

The selenium sensitization will be described below.

Selenium compounds disclosed in the patents enumerated above in "Description of the Related Art" can be used as a selenium sensitizer for use in the present invention. In particular, it is possible to use a labile selenium compound and/or a non-labile selenium compound which can form silver selenide by reacting with silver nitrate in an aqueous solution at high temperatures, preferably 40° C. or more.

Preferable examples of the labile selenium compound are described in JP-B-44-15748, JP-B-43-13489, EP-0458278A1, and JP-A-4-109240. Practical examples of the labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferable examples of the labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of the selenium sensitizer has no important role except the role of carrying selenium and keeping it in a labile state in an emulsion. In the present invention, therefore, labile selenium compounds in this extensive concept are advantageously used.

Examples of the non-labile selenium compound used in the present invention are those described in JP-B-46-4553, JP-B-52-34492, and JP-B-52-34491. Specific examples of the non-labile selenium compound are selenious acid, potassium selenocyanide, selenazoles, quaternary salts of selenazoles, diarylselenide, diaryldiselenide, dialkylselenide, dialkyldiselenide, 2-selenazolidinedione, 2-selenoxazolidinethione, and derivatives of these compounds.

Among these selenium compounds, those preferably used in the present invention are compounds represented by Formulas (A) and (B) below.

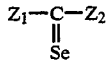

Formula (A)

wherein $Z_1$ and $Z_2$ may be the same or different and each represents an alkyl group (e.g., methyl, ethyl, t-butyl, adamantyl, and t-octyl), an alkenyl group (e.g., vinyl and propenyl), an aralkyl group (e.g., benzyl and phenethyl), an aryl group (e.g., phenyl, pentafluorophenyl, 4-chlorophenyl, 3-nitrophenyl, 4-octylsulfamoylphenyl, and °-naphthyl), a heterocyclic group (e.g., pyridyl, thienyl, furyl, and imidazolyl), $—NR_1(R_2)$, $—OR_3$, or $—SR_4$.

$R_1$, $R_2$, $R_3$, and $R_4$ may be the same of different and each represents an alkyl group, an aralkyl group, an aryl group, or a heterocyclic group. Examples of the alkyl group, the aralkyl group, the aryl group, and the heterocyclic group can be the same as those enumerated above for $Z_1$.

Note that $R_1$ and $R_2$ each can be a hydrogen atom or an acyl group (e.g., acetyl, propanoyl, benzoyl, heptafluorobutanoyl, difluoroacetyl, 4-nitrobenzoyl, α-naphthoyl, and 4-trifluoromethylbenzoyl).

In Formula (A), $Z_1$ preferably represents an alkyl group, an aryl group, or $—NR_1(R_2)$ and $Z_2$ preferably represents $—NR_5(R_6)$ wherein $R_1$, $R_2$, $R_5$, and $R_6$ may be the same or different and each represents a hydrogen atom, an alkyl group, an aryl group, or an acyl group.

More preferable examples of a selenium compound represented by Formula (A) are N,N-dialkylselenourea, N,N,N'-trialkyl-N'-acylselenourea, tetraalkylselenourea, N,N-dialkyl-arylselenoamide, and N-alkyl-N-aryl-arylselenoamide.

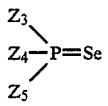

Formula (B)

wherein $Z_3$, $Z_4$, and $Z_5$ may be the same or different and each represents an aliphatic group, an aromatic group, a heterocyclic group, $—OR_7$, $—NR_8(R_9)$, $—SR_{10}$, $—SeR_{11}$, X, or a hydrogen atom.

$R_7$, $R_{10}$, and $R_{11}$ each represents an aliphatic group, an aromatic group, a heterocyclic group, a hydrogen atom, or a cation, and $R_8$ and $R_9$ each represents an aliphatic group, an aromatic group, a heterocyclic group, or a hydrogen atom. X represents a halogen atom.

In Formula (B), an aliphatic group represented by $Z_3$, $Z_4$, $Z_5$, $R_7$, $R_8$, $R_9$, $R_{10}$, or $R_{11}$ represents a straight-chain, branched, or cyclic alkyl, alkenyl, alkinyl, or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, and phenethyl).

In Formula (B), an aromatic group represented by $Z_3$, $Z_4$, $Z_5$, $R_7$, $R_8$, $R_9$, $R_{10}$, or $R_{11}$ represents a monocyclic or condensed-ring aryl group (e.g., phenyl, pentafluorophenyl, 4-chlorophenyl, 3-sulfophenyl, α-naphthyl, and 4-methylphenyl).

In Formula (B), a heterocyclic group represented by $Z_3$, $Z_4$, $Z_5$, $R_7$, $R_8$, $R_9$, $R_{10}$ or $R_{11}$ represents a 3- to 10-membered saturated or unsaturated heterocyclic group (e.g., pyridyl, thienyl, furyl, thiazolyl, imidazolyl, and benzimidazolyl) containing at least one of a nitrogen atom, an oxygen atom, and a sulfur atom.

In Formula (B), a cation represented by $R_7$, $R_{10}$, or $R_{11}$ represents an alkali metal atom or ammonium, and a halogen atom represented by X represents e.g., a fluorine atom, a chlorine atom, a bromine atom, or an iodine atom.

In Formula (B), $Z_3$, $Z_4$, and $Z_5$ preferably represents an aliphatic group, an aromatic group, or $—OR_7$, and $R_7$ preferably represents an aliphatic group or an aromatic group.

More preferable examples of a compound represented by Formula (B) are trialkylphosphineselenide, triarylphosphineselenide, trialkylselenophosphate, and triarylselenophosphate.

Practical examples of compounds represented by Formulas (A) and (B) are presented below, but the present invention is not limited to these examples.

1.

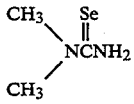

2.

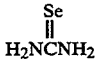

3.

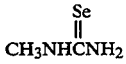

4.

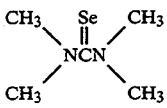

-continued

5.

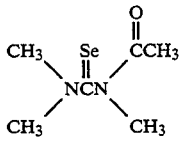

6.

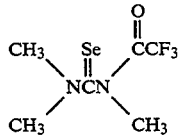

7.

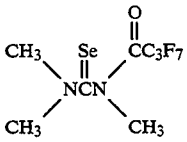

8.

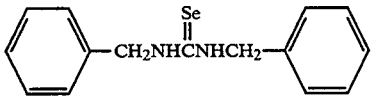

9.

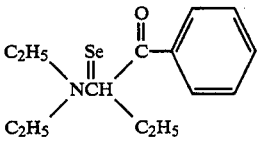

10.

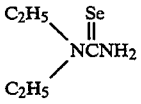

11.

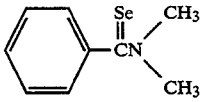

12.

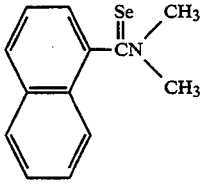

13.

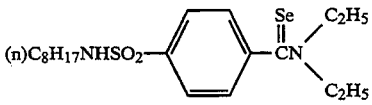

14.

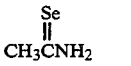

15.

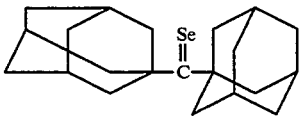

16.

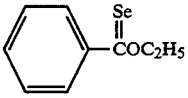

-continued

17.

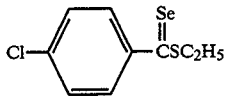

18.

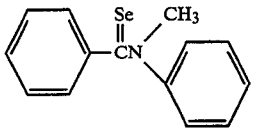

19.

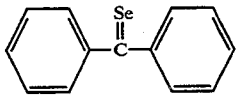

20.

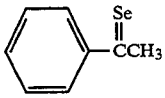

21.

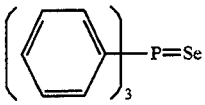

22.

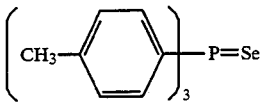

23.

$(nC_4H_9)_3P{=}Se$

24.

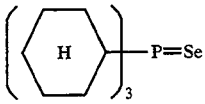

25.

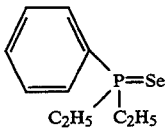

26.

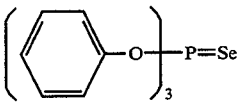

27.

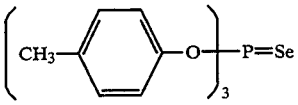

28.

$(nC_4H_9O)_3P{=}Se$

29.

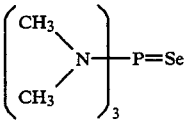

30.

$(C_2H_5O)_3P{=}Se$

-continued

31.

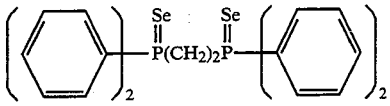

32.

$(nC_8H_{17})_3P{=}Se$

33.

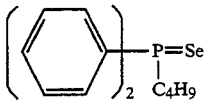

34.

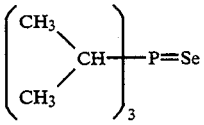

35.

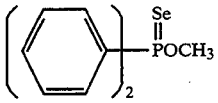

36.

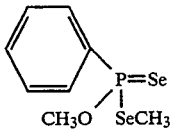

37.

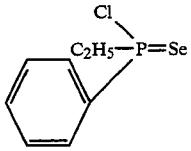

38.

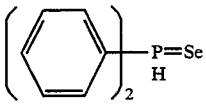

39.

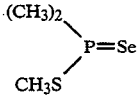

40.

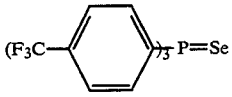

41.

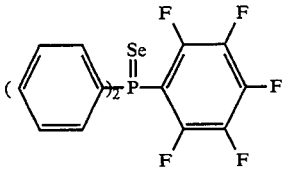

These selenium sensitizers are dissolved in water, an organic solvent, such as methanol or ethanol, or a solvent mixture of these organic solvents, and the resultant solution is added during chemical sensitization. The addition is preferably performed after formation of grains and after desalting. A selenium sensitizer used is not limited to one type, but two or more types of the selenium sensitizers described above can be used together.

The addition amount of the selenium sensitizers used in the present invention changes in accordance with the activity of each selenium sensitizer used, the type or grain size of a silver halide, and the temperature and time of ripening. The addition amount, however, is preferably $1\times10^{-8}$ mole or more, and more preferably $1\times10^{-7}$ to $5\times10^{-5}$ mole per mole of a silver halide. When the selenium sensitizers are used, the temperature of chemical ripening is preferably 45° C. or more, and more preferably 50° C. to 80° C. Although the pAg and the pH can be arbitrarily set, the pAg and the pH are preferably 7 to 10 and 4 to 9, respectively.

The selenium sensitization in the present invention can be performed more effectively in the presence of a solvent for silver halide.

Examples of the silver halide solvent usable in the present invention are (a) organic thioethers described in, e.g., U.S. Pat. Nos. 3,271,157, 3,531,289, and 3,574,628, JP-A-54-1019, and JP-A-54-158917, (b) thiourea derivatives described in JP-A-53-82408, JP-A-55-77737, and JP-A-55-2982, (c) a silver halide solvent having a thiocarbonyl group sandwiched between an oxygen or sulfur atom and a nitrogen atom described in JP-A-53-144319, (d) imidazoles described in JP-A-54-100717, (e) sulfites, and (f) thiocyanate.

Most preferable examples of the solvent are thiocyanate and tetramethylthiourea. Although the amount of the solvent to be used changes in accordance with its type, a preferable amount of, e.g., thiocyanate is $1\times10^{-4}$ to $1\times10^{-2}$ mole per mole of a silver halide.

It is preferable that the silver halide emulsion of the present invention be also subjected to sulfur sensitization and/or gold sensitization in the chemical sensitization.

The sulfur sensitization is normally performed by adding a sulfur sensitizer to an emulsion and stirring the resultant emulsion at a high temperature of preferably 40° C. or more for a predetermined time.

The gold sensitization is normally performed by adding a gold sensitizer to an emulsion and stirring the resultant emulsion at a high temperature of preferably 40° C. or more for a predetermined time.

Sulfur sensitizers known to those skilled in the art can be used in the sulfur sensitization. Examples of the sulfur sensitizer are thiosulfate, allylthiocarbamide, thiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016. The addition amount of the sulfur sensitizer need only be the one that can effectively increase the sensitivity of an emulsion. Although this amount changes over a wide range in accordance with various conditions, such as a pH, a temperature, and the size of silver halide grains, it is preferably $1\times10^{-7}$ to $5\times10^{-5}$ mole per mole of a silver halide.

The gold sensitizer for use in the gold sensitization can be any compound having an oxidation number of gold of +1 or +3, and it is possible to use gold compounds normally used as a gold sensitizer. Representative examples of the gold sensitizer are chloroaurate, potassium chloroaurate, auricrichloride, potassium auricthiocyanate, potassium iodoaurate, tetracyanoauric acid, ammonium aurothiacyanate, and pyridyltrichlorogold.

Although the addition amount of the gold sensitizer changes in accordance with various conditions, it is preferably $1\times10^{-7}$ and $5\times10^{-5}$ mole per mole of a silver halide.

In chemical ripening, it is not particularly necessary to limit the addition timings and the addition order of the silver halide solvent and the selenium, sulfur, and gold sensitizers. For example, the above compounds can be added simultaneously or at different addition timings in (preferably) the initial stage of or during the chemical ripening. The above compounds are dissolved in water, an organic solvent mixable with water, such as methanol, ethanol, or acetone, or a solvent mixture of these organic solvents, and the resultant solution is added to an emulsion.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. No. 4,663,271, U.S. Pat. No. 4,705,744, U.S. Pat. No. 4,707,436, JP-A-62-160448, and JP-A-63-89850.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromoiodide containing about 30 mol % or less of silver iodide. The most preferable silver halide is silver bromoiodide or silver chlorobromoiodide containing about 2 mol % to about 10 mol % of silver iodide.

Silver halide grains contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be Joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later. These various additives can be widely used together with the chemical sensitizers and the spectral sensitizers used in the present invention.

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of ±40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

TABLE A

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | pp. 868 |
| 5. Antifoggants, stabilizers | pp. 24–25 | page 649, right column | pp. 868–870 |
| 6. Light absorbent, filter dye, ultraviolet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glycerol-tributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness—film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)anline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl-)aniline, 4-amino-3-methyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4hydroxybutyl)aniline, and the sulfates, hydrochlorides and p-toluenesulfonates thereof. Of these compounds, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(3-hydroxybutyl)aniline, and the sulfates, hydrochlorides and p-toluenesulfonates thereof are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonlc acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in West German Patents 966,410 and 2,748,430; polyamine compounds described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248-253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The present invention will be described in more detail below by way of its examples, but the invention is not limited to these examples.

EXAMPLE 1

Preparation of Emulsions Em-1 to Em-21

1,000 ml of an aqueous solution containing 7.0 g of gelatin and 3.0 g of KBr was stirred at 45° C. An aqueous silver nitrate solution ($AgNO_3$ 8.2 g) and an aqueous silver halide solution (KBr 5.7 g and KI 0.35 g) were added to the solution by a double-jet method over one minute. After 21.5 g of gelatin were added to the resultant solution, the solution was heated up to 75° C. An aqueous silver nitrate solution ($AgNO_3$ 100 g) and an aqueous KBr solution were added to the resultant solution by the double-Jet method while accelerating the flow rate over 30 minutes. During the addition, the silver potential was kept at 0 mV with respect to a saturated calomel electrode. The temperature was decreased to 50° C., and an aqueous KI solution (KI 3.5 g) was added to the solution over two minutes.

Thereafter, an aqueous silver nitrate solution ($AgNO_3$ 8.2 g) and an aqueous KBr solution were added to the resultant solution by the double-jet method over 15 minutes. During the addition, the silver potential was kept at −15 mV with respect to the saturated calomel electrode. The emulsion prepared was desalted by a flocculation process and added with gelatin, and its pH and pAg were adjusted to 5.5 and 8.8, respectively. The obtained emulsion was a tabular grain emulsion having an average diameter as sphere of 0.68 μm, a variation coefficient of 25%, and an average aspect ratio of 8.0.

This emulsion was divided into 21 portions, and these 10 emulsion portions were subjected to different chemical and spectral sensitization methods to be described below, thereby obtaining emulsions Em-1 to Em-21.

(1) Chemical sensitization was performed optimally by raising the temperature to 56° C. and adding $1.5\times10^{-5}$ mole/mole Ag of sodium thiosulfate, $3.2\times10^{-6}$ mole/moleAg of chloroauric acid, and $1.9\times10^{-3}$ mole/moleAg of potassium thiocyanate. Thereafter, spectral sensitization was performed by the addition of 0.01 g/moleAg, 0.10 g/moleAg, and 0.01 g/moleAg of comparative sensitizing dyes S-1, S-2, and S-7, respectively. The emulsion prepared was labeled Em-1 (Gold-sulfur sensitization).

(2) The same procedures as for Em-1 were followed except that the comparative sensitizing dye S-1 was replaced with an equal molar quantity of the comparative sensitizing dye S-9. The emulsion prepared was labeled Em-2 (Gold-sulfur sensitization).

(3) The same procedures as for Em-1 were followed except that the comparative sensitizing dye S-1 was replaced with an equal molar quantity of the exemplified sensitizing dye I-1. The emulsion prepared was labeled Em-3 (Gold-sulfur sensitization).

(4) The same procedures as for Em-1 were followed except that the comparative sensitizing dye S-1 was replaced with an equal molar quantity of the exemplified sensitizing dye I-4. The emulsion prepared was labeled Em-4 (Gold-sulfur sensitization).

(5) The same procedures as for Em-1 were followed except that the comparative sensitizing dye S-1 was replaced with an equal molar quantity of the exemplified sensitizing dye I-12. The emulsion prepared was labeled Em-5 (Gold-sulfur sensitization).

(6) The same procedures as for Em-1 were followed except that $9.8\times10^{-6}$ mole/moleAg of the exemplified compound 1 was added as a selenium sensitizer instead of sodium thiosulfate to perform an optimal chemical sensitization. The emulsion prepared was labeled Em-6 (Gold-selenium sensitization).

(7) The same procedures as for Em-6 were followed except that the comparative sensitizing dye S-1 was replaced with an equal molar quantity of the comparative sensitizing dye S-9. The emulsion prepared was labeled Em-7 (Gold-selenium sensitization).

(8) The same procedures as for Em-6 were followed except that the comparative sensitizing dye S-1 was replaced with an equal molar quantity of the exemplified sensitizing dye I-1. The emulsion prepared was labeled Em-8 (Gold-selenium sensitization).

(9) The same procedures as for Em-6 were followed except that the comparative sensitizing dye S-1 was replaced with an equal molar quantity of the exemplified sensitizing dye I-4. The emulsion prepared was labeled Em-9 (Gold-selenium sensitization).

(10) The same procedures as for Em-6 were followed except that the comparative sensitizing dye S-1 was replaced with an equal molar quantity of the exemplified sensitizing dye I-12. The emulsion prepared was labeled Em-10 (Gold-selenium sensitization).

(11) The same procedures as for Em-1 were followed except that the amount of sodium thiosulfate was changed to $0.9\times10^{-5}$ mole/moleAg and $3.9\times10^{-6}$ mole/moleAg of the exemplified compound 1 was added as a selenium sensitizer to perform an optimal chemical sensitization. The emulsion prepared was labeled Em-11 (Gold-sulfur-selenium sensitization).

(12) The same procedures as for Em-11 were followed except that the comparative sensitizing dye S-1 was replaced with an equal molar quantity of the comparative sensitizing dye S-9. The emulsion prepared was labeled Em-12 (Gold-sulfur-selenium sensitization).

(13) The same procedures as for Em-11 were followed except that the comparative sensitizing dye S-1 was replaced with an equal molar quantity of the exemplified sensitizing dye I-1. The emulsion prepared was labeled Em-13 (Gold-sulfur-selenium sensitization).

(14) The same procedures As for Em-11 were followed except that the comparative sensitizing dye S-1 was replaced with an equal molar quantity of the exemplified sensitizing dye I-4. The emulsion prepared was labeled Em-14 (Gold-sulfur-selenium sensitization).

(15) The same procedures as for Em-11 were followed except that the comparative sensitizing dye S-1 was replaced with an equal molar quantity of the exemplified sensitizing dye I-12. The emulsion prepared was labeled Em-15 (Gold-sulfur-selenium sensitization).

(16) The same procedures as for Em-13 were followed except that the exemplified compound 1 was replaced with an equal molar quantity of the exemplified compound 16 to perform an optimal chemical sensitization. The emulsion prepared was labeled Em-16 (Gold-sulfur-selenium sensitization).

(17) The same procedures as for Em-13 were followed except that the exemplified compound 1 was replaced with an equal molar quantity of the exemplified compound 19 to perform an optimal chemical sensitization. The emulsion prepared was labeled Em-17 (Gold-sulfur-selenium sensitization).

(18) The same procedures as for Em-13 were followed except that the exemplified compound 1 was replaced with an equal molar quantity of the exemplified compound 21 to perform an optimal chemical sensitization. The emulsion prepared was labeled Em-18 (Gold-sulfur-selenium sensitization).

(19) The same procedures as for Em-13 were followed except that the exemplified compound 1 was replaced with an equal molar quantity of the exemplified compound 33 to perform an optimal chemical sensitization. The emulsion prepared was labeled Em-19 (Gold-sulfur-selenium sensitization).

(20) The same procedures as for Em-13 were followed except that the exemplified compound 1 was replaced with an equal molar quantity of the exemplified compound 37 to perform an optimal chemical sensitization. The emulsion prepared was labeled Em-20 (Gold-sulfur-selenium sensitization).

(21) The same procedures as for Em-13 were followed except that the exemplified compound 1 was replaced with an equal molar quantity of the exemplified compound 41 to perform an optimal chemical sensitization. The emulsion prepared was labeled Em-21 (Gold-sulfur-selenium sensitization).

The "optimal chemical sensitization" means chemical sensitization after which the highest sensitivity is obtained upon exposure for 1/100 second.

Making of Samples 101–121

The emulsions Em-1 to Em-121 were added with coating aids and viscosity modifiers and coated in an amount of 1.1 g/m$^2$ as a silver amount, thereby making samples 101 to 121, respectively.

After the coating, the sample pieces thus obtained were subjected to film hardening at a temperature of 30° C. and a relative humidity of 60% for 14 days. The resultant samples were stored in a freezer or forcibly degraded at a temperature of 60° C. and a relative humidity of 80% for three days. The samples thus processed were subjected to white exposure through a gray wedge for a exposure time of 1/100 second and processed by the following method (black-and-white development). Thereafter, sensitometry was performed for these samples.

The relative sensitivity of each sample is represented by a relative value assuming that the reciprocal of an exposure amount required for the sample 101 to give a density of fog+0.2 is 100.

The storage stability in fog is evaluated by the value obtained by subtracting the value of fog of the sample stored in a freezer from that of the sample forcibly degraded.

The results are summarized in Table 1 below.

TABLE 1

| Sample No. | Chemical sensitization | Selenium compound | Sensitizing dye | Relative sensitivity | Change in fog with time*) |
|---|---|---|---|---|---|
| 101 Comparative Example | Gold-sulfur | — | S-1,S-2, S-7 | 100 | +0.04 |
| 102 Comparative Example | Gold-sulfur | — | S-9,S-2, S-7 | 100 | +0.06 |
| 103 Comparative Example | Gold-sulfur | — | I-1,S-2, S-7 | 101 | +0.01 |
| 104 Comparative Example | Gold-sulfur | — | I-4,S-2, S-7 | 100 | +0.01 |
| 105 Comparative Example | Gold-sulfur | — | I-12,S-2 S-7 | 100 | +0.02 |
| 106 Comparative Example | Gold-selenium | Exemplified compound 1 | S-1,S-2, S-7 | 132 | +0.28 |
| 107 Comparative Example | Gold-selenium | Exemplified compound 1 | S-9,S-2, S-7 | 132 | +0.32 |
| 108 Invention | Gold-selenium | Exemplified compound 1 | I-1,S-2, S-7 | 132 | +0.06 |
| 109 Invention | Gold-selenium | Exemplified compound 1 | I-4,S-2, S-7 | 131 | +0.06 |
| 110 Invention | Gold-selenium | Exemplified compound 1 | I-12,S-2, S-7 | 131 | +0.07 |
| 111 Comparative Example | Gold-sulfur-selenium | Exemplified compound 1 | S-1,S-2, S-7 | 126 | +0.13 |
| 112 Comparative Example | Gold-sulfur-selenium | Exemplified compound 1 | S-9,S-2, S-7 | 126 | +0.16 |
| 113 Invention | Gold-sulfur-selenium | Exemplified compound 1 | I-1,S-2, S-7 | 127 | +0.04 |
| 114 Invention | Gold-sulfur-selenium | Exemplified compound 1 | I-4,S-2, S-7 | 126 | +0.05 |
| 115 Invention | Gold-sulfur-selenium | Exemplified compound 1 | I-12,S-2, S-7 | 126 | +0.06 |
| 116 Invention | Gold-sulfur-selenium | Exemplified compound 16 | I-1,S-2, S-7 | 124 | +0.06 |
| 117 Invention | Gold-sulfur-selenium | Exemplified compound 19 | I-1,S-2, S-7 | 126 | +0.05 |
| 118 Invention | Gold-sulfur-selenium | Exemplified compound 21 | I-1,S-2, S-7 | 128 | +0.03 |
| 119 Invention | Gold-sulfur-selenium | Exemplified compound 33 | I-1,S-2, S-7 | 125 | +0.04 |
| 120 Invention | Gold-sulfur-selenium | Exemplified compound 37 | I-1,S-2, S-7 | 125 | +0.06 |
| 121 Invention | Gold-sulfur-selenium | Exemplified compound 41 | I-1,S-2, S-7 | 126 | +0.03 |

*)The value obtained by subtracting the fog of the sample stored in a freezer from that of the sample stored at a temperature of 60° C. and a relative humidity of 80% for three days.

| Processing Method | | |
|---|---|---|
| Process | Time | Temperature |
| Black-and-white development | 4 min. | 38° C. |
| Washing | 2 min. | 38° C. |
| Fixing | 4 min. | 38° C. |

-continued

| Processing Method | | |
|---|---|---|
| Process | Time | Temperature |
| Washing | 4 min. | 38° C. |

The compositions of the processing solutions were as follows.

| (Black-and-white developing solution) | |
|---|---|
| Nitrilo-N,N,N-trimethylenephosphonic acid.pentasodium salt | 2.0 g |
| Sodium sulfite | 30 g |
| Hydroquinone.potassium monosulfonate | 20 g |
| Potassium carbonate | 33 g |
| 1-phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1,000 ml |
| pH | 9.60 |

The pH was controlled by hydrochloric acid or potassium hydroxide.

| (Fixing solution) | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

The pH was controlled by hydrochloric acid or ammonia water.

As can be seen from Table 1, in the emulsions using the sensitizing dyes S-1 and S-9, although high sensitivities were achieved by changing the chemical sensitization from gold-sulfur sensitization to gold-selenium sensitization and to gold-sulfur-selenium sensitization, this was accompanied by the unpreferable result that the fog increased significantly with time. In the emulsions subjected to the gold-sulfur sensitization, the increases in fog with time were suppressed by using the sensitizing dyes I-1, I-4 and I-12 in place of the sensitizing dye S-1 or S-9, but no high enough sensitivity could be obtained in that case. The preferable results such as sufficiently high sensitivities and relatively low increases in fog with time were not able to be obtained unless the present invention were used.

EXAMPLE 2

Making of Sample 201

Layers having the following compositions were formed on a subbed cellulose triacetate film support 127 μm in thickness, thereby making a multilayered color light-sensitive material, sample 201. Note that the emulsion Em-1 formed in Example 1 was used in the sixth layer. Numbers represent addition amounts per $m^2$. Note also that the effects of the added compounds are not limited to those described below.

| 1st layer: Antihalation layer | |
|---|---|
| Black colloidal silver | 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |

-continued

| | | |
|---|---|---|
| High-boiling organic solvent Oil-1 | | 0.1 g |
| Fine crystal solid dispersion of dye E-1 | | 0.1 g |
| 2nd layer: Interlayer | | |
| Gelatin | | 0.40 g |
| Compound Cpd-C | | 5 mg |
| Compound Cpd-J | | 5 mg |
| Compound Cpd-K | | 3 mg |
| High-boiling organic solvent Oil-3 | | 0.1 g |
| Dye D-4 | | 0.4 mg |
| 3rd layer: Interlayer | | |
| Fine grain silver bromoiodide emulsion fogged both on surface and in interior (average grain size 0.06 μm, variation coefficient 18%, AgI content 1 mol %) | silver | 0.05 g |
| Gelatin | | 0.4 g |
| 4th layer: Low-speed red-sensitive emulsion layer | | |
| Emulsion A | silver | 0.1 g |
| Emulsion B | silver | 0.4 g |
| Gelatin | | 0.8 g |
| Coupler C-1 | | 0.15 g |
| Coupler C-2 | | 0.05 g |
| Coupler C-3 | | 0.05 g |
| Coupler C-9 | | 0.05 g |
| Compound Cpd-C | | 10 mg |
| High-boiling organic solvent Oil-2 | | 0.1 g |
| Additive P-1 | | 0.1 g |
| 5th layer: Medium-speed red-sensitive emulsion layer | | |
| Emulsion B | silver | 0.2 g |
| Emulsion C | silver | 0.3 g |
| Gelatin | | 0.8 g |
| Coupler C-1 | | 0.2 g |
| Coupler C-2 | | 0.05 g |
| Coupler C-3 | | 0.2 g |
| High-boiling organic solvent Oil-2 | | 0.1 g |
| Additive P-1 | | 0.1 g |
| 6th layer: High-speed red-sensitive emulsion layer | | |
| Em-1 | silver | 0.4 g |
| Gelatin | | 1.1 g |
| Coupler C-1 | | 0.3 g |
| Coupler C-2 | | 0.1 g |
| Coupler C-3 | | 0.7 g |
| Additive P-1 | | 0.1 g |
| 7th layer: Interlayer | | |
| Gelatin | | 0.6 g |
| Additive M-1 | | 0.3 g |
| Color-mixing inhibitor Cpd-I | | 2.6 mg |
| Ultraviolet absorbent U-1 | | 0.01 g |
| Ultraviolet absorbent U-2 | | 0.002 g |
| Ultraviolet absorbent U-5 | | 0.01 g |
| Dye D-1 | | 0.02 g |
| Dye D-5 | | 0.02 g |
| Compound Cpd-C | | 5 mg |
| Compound Cpd-J | | 5 mg |
| Compound Cpd-K | | 5 mg |
| High-boiling organic solvent Oil-1 | | 0.02 g |
| 8th layer: Interlayer | | |
| Silver bromoiodide emulsion fogged both on surface and in interior (average grain size 0.06 μm, variation coefficient 16%, AgI content 0.3 mol %) | silver | 0.02 g |
| Gelatin | | 1.0 g |
| Additive P-1 | | 0.2 g |
| Color-mixing inhibitor Cpd-A | | 0.1 g |
| 9th layer: Low-speed green-sensitive emulsion layer | | |
| Emulsion D | silver | 0.1 g |
| Emulsion E | silver | 0.2 g |
| Emulsion F | silver | 0.2 g |
| Gelatin | | 0.5 g |
| Coupler C-4 | | 0.1 g |
| Coupler C-7 | | 0.05 g |
| Coupler C-8 | | 0.20 g |
| Compound Cpd-B | | 0.03 g |
| Compound Cpd-C | | 10 mg |
| Compound Cpd-D | | 0.02 g |
| Compound Cpd-E | | 0.02 g |
| Compound Cpd-F | | 0.02 g |
| Compound Cpd-G | | 0.02 g |
| Compound Cpd-L | | 0.05 g |
| High-boiling organic solvent Oil-1 | | 0.1 g |
| High-boiling organic solvent Oil-2 | | 0.1 g |

-continued

| | | |
|---|---|---|
| 10th layer: Medium-speed green-sensitive emulsion layer | | |
| Emulsion F | silver | 0.3 g |
| Emulsion G | silver | 0.1 g |
| Gelatin | | 0.6 g |
| Coupler C-4 | | 0.1 g |
| Coupler C-7 | | 0.2 g |
| Coupler C-8 | | 0.1 g |
| Compound Cpd-B | | 0.03 g |
| Compound Cpd-D | | 0.02 g |
| Compound Cpd-E | | 0.02 g |
| Compound Cpd-F | | 0.05 g |
| Compound Cpd-G | | 0.05 g |
| Compound Cpd-L | | 0.05 g |
| High-boiling organic solvent Oil-2 | | 0.01 g |
| 11th layer: High-speed green-sensitive emulsion layer | | |
| Emulsion H | silver | 0.5 g |
| Gelatin | | 1.0 g |
| Coupler C-4 | | 0.3 g |
| Coupler C-7 | | 0.1 g |
| Coupler C-8 | | 0.1 g |
| Compound Cpd-B | | 0.08 g |
| Compound Cpd-C | | 5 mg |
| Compound Cpd-D | | 0.02 g |
| Compound Cpd-E | | 0.02 g |
| Compound Cpd-F | | 0.02 g |
| Compound Cpd-G | | 0.02 g |
| Compound Cpd-J | | 5 mg |
| Compound Cpd-K | | 5 mg |
| Compound Cpd-L | | 0.05 g |
| High-boiling organic solvent Oil-1 | | 0.02 g |
| High-boiling organic solvent Oil-2 | | 0.02 g |
| 12th layer: Interlayer | | |
| Gelatin | | 0.6 g |
| 13th layer: Yellow filter layer | | |
| Yellow colloidal silver | silver | 0.07 g |
| Gelatin | | 1.1 g |
| Color-mixing inhibitor Cpd-A | | 0.01 g |
| High-boiling organic solvent Oil-1 | | 0.01 g |
| Fine crystal solid dispersion of Dye E-2 | | 0.05 g |
| 14th layer: Interlayer | | |
| Gelatin | | 0.6 g |
| 15th layer: Low-speed blue-sensitive emulsion layer | | |
| Emulsion I | silver | 0.2 g |
| Emulsion J | silver | 0.3 g |
| Emulsion K | silver | 0.1 g |
| Gelatin | | 0.8 g |
| Coupler C-5 | | 0.2 g |
| Coupler C-6 | | 0.1 g |
| Coupler C-10 | | 0.4 g |
| 16th layer: Medium-speed blue-sensitive emulsion layer | | |
| Emulsion K | silver | 0.1 g |
| Emulsion L | silver | 0.4 g |
| Gelatin | | 0.9 g |
| Coupler C-5 | | 0.1 g |
| Coupler C-6 | | 0.1 g |
| Coupler C-10 | | 0.6 g |
| 17th layer: High-speed blue-sensitive emulsion layer | | |
| Emulsion M | silver | 0.4 g |
| Gelatin | | 1.2 g |
| Coupler C-5 | | 0.1 g |
| Coupler C-6 | | 0.1 g |
| Coupler C-10 | | 0.6 g |
| High-boiling organic solvent Oil-2 | | 0.1 g |
| 18th layer: 1st protective layer | | |
| Gelatin | | 0.7 g |
| Ultraviolet absorbent U-1 | | 0.2 g |
| Ultraviolet absorbent U-2 | | 0.05 g |
| Ultraviolet absorbent U-5 | | 0.3 g |
| Formalin scavenger Cpd-H | | 0.4 g |
| Dye D-1 | | 0.1 g |
| Dye D-2 | | 0.05 g |
| Dye D-3 | | 0.1 g |
| 19th layer: 2nd protective layer | | |
| Colloidal silver | silver | 0.1 mg |
| Fine grain silver bromoiodide emulsion (average grain size 0.06 μm, AgI content 1 mol %) | silver | 0.1 g |
| Gelatin | | 0.4 g |
| 20th layer: 3rd protective layer | | |
| Gelatin | | 0.4 g |

-continued

| | |
|---|---|
| Polymethylmethacrylate (average grain size 1.5 μm) | 0.1 g |
| 4:6 copolymer of methylmethacrylate and acrylic acid (average grain size 1.5 μm) | 0.1 g |
| Silicone oil | 0.03 g |
| Surfactant W-1 | 3.0 mg |
| Surfactant W-2 | 0.03 g |

In addition to the above compositions, additives F-1 to F-8 were added to each emulsion layer. The layers were also added with a gelatin hardener H-1 and surfactants W-3, W-4, W-5, and W-6 for coating and emulsification purposes.

In addition, phenol, 1,2-benzisothiazoline-3-one, 2-phenoxyethanol, phenethylalcohol, and p-benzoic acid butyl ester were added as antiseptic and mildewproofing agents.

TABLE 2

Silver bromoiodide emulsions used in the sample 201 were as follows.

| Emulsion name | Characteristics of grain | Average diameter as sphere (μm) | Variation coefficient (%) | AgI content (%) |
|---|---|---|---|---|
| A | Monodisperse tetradecahedral grain | 0.28 | 16 | 3.7 |
| B | Monodisperse cubic internal latent image grain | 0.30 | 10 | 3.3 |
| C | Mondisperse tabular grain, average aspect ratio 4.0 | 0.38 | 18 | 5.0 |
| D | Monodisperse cubic grain | 0.20 | 17 | 4.0 |
| E | Monodisperse cubic grain | 0.23 | 16 | 4.0 |
| F | Monodisperse cubic internal latent image grain | 0.28 | 11 | 3.5 |
| G | Monodisperse cubic internal latent image grain | 0.32 | 9 | 3.5 |
| H | Tabular grain, average aspect ratio 9.0 | 0.80 | 28 | 1.5 |
| I | Monodisperse tetradecahedral grain | 0.30 | 18 | 4.0 |
| J | Monodisperse tabular grain, average aspect ratio 7.0 | 0.45 | 17 | 4.0 |
| K | Monodisperse cubic internal latent image grain | 0.46 | 14 | 3.5 |
| L | Monodisperse tabular grain, average aspect ratio 10.0 | 0.55 | 13 | 4.0 |
| M | Tabular grain, average aspect ratio 12.0 | 1.00 | 33 | 1.3 |

TABLE 3

Spectral sensitization of emulsions A to G

| Emulsion name | Sensitizing dye added | Addition amount (g) per 1 mol of silver halide |
|---|---|---|
| A | S-1 | 0.025 |
| | S-2 | 0.25 |
| | S-7 | 0.01 |
| B | S-1 | 0.01 |
| | S-2 | 0.25 |
| | S-7 | 0.01 |
| C | S-1 | 0.02 |
| | S-2 | 0.25 |
| | S-7 | 0.01 |
| D | S-3 | 0.5 |
| | S-4 | 0.1 |
| E | S-3 | 0.3 |
| | S-4 | 0.1 |
| F | S-3 | 0.25 |
| | S-4 | 0.08 |
| | S-8 | 0.05 |
| G | S-3 | 0.2 |
| | S-4 | 0.06 |
| | S-8 | 0.05 |

TABLE 4

Spectral sensitization of emulsions H to M

| Emulsion name | Sensitizing dye added | Addition amount (g) per 1 mol of silver halide |
|---|---|---|
| H | S-3 | 0.3 |
| | S-4 | 0.07 |
| | S-8 | 0.1 |
| I | S-5 | 0.05 |
| | S-6 | 0.2 |
| J | S-5 | 0.05 |
| | S-6 | 0.2 |
| K | S-5 | 0.06 |
| | S-6 | 0.22 |
| L | S-5 | 0.04 |
| | S-6 | 0.15 |
| M | S-5 | 0.06 |
| | S-6 | 0.22 |

C-1

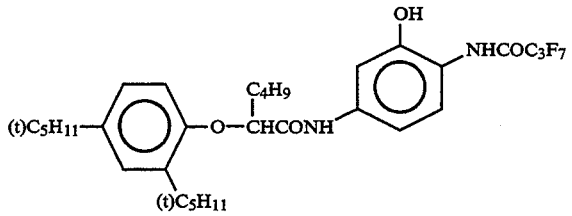

C-2

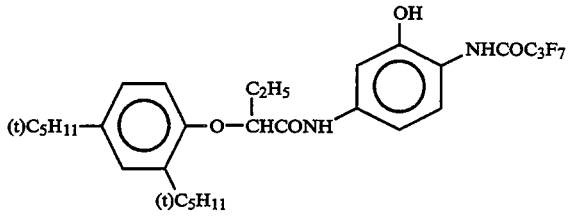

-continued
C-3
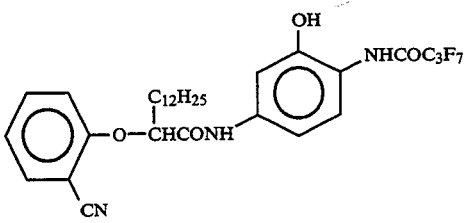
C-4
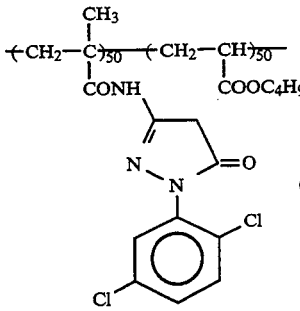
(the number represents wt %, mean molecular weight: about 25,000)
C-5
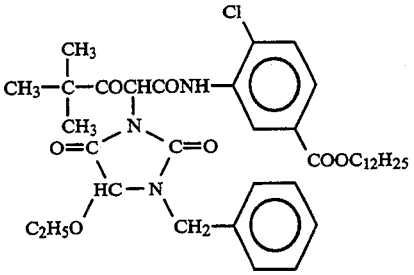
C-6
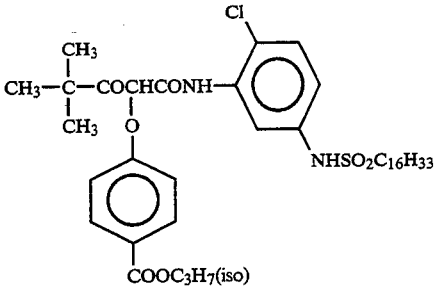
C-7
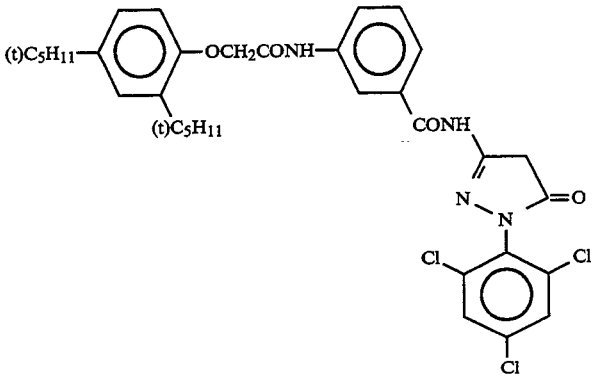
C-8
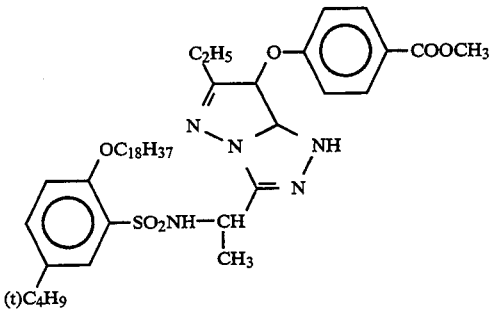
C-9
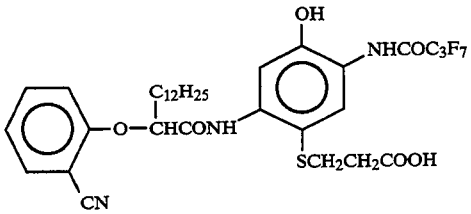
C-10
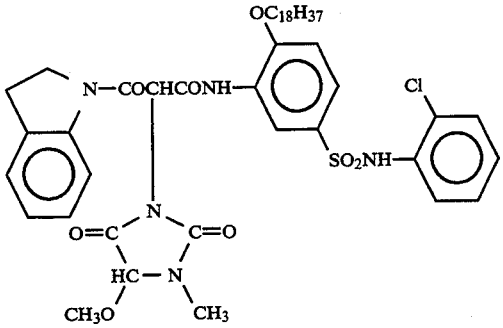
dibutyl phtalate
Oil-1

-continued
tricresyl posphate
Oil-2
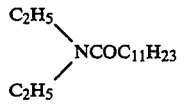
Oil-3
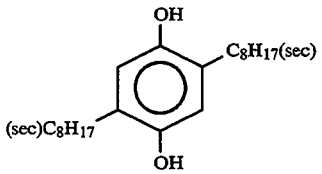
Cpd-A
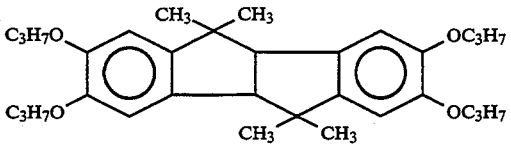
Cpd-B
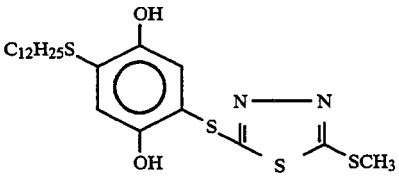
Cpd-C
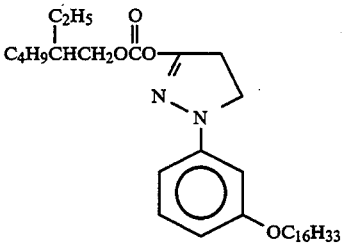
Cpd-D
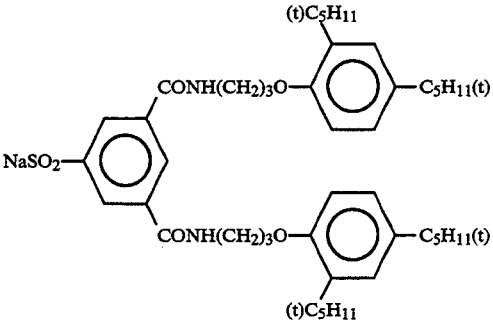
Cpd-E
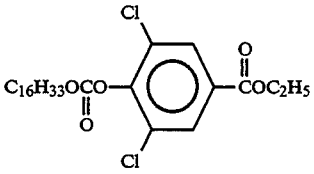
Cpd-F
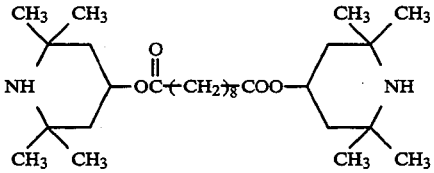
Cpd-G
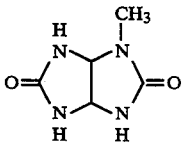
Cpd-H
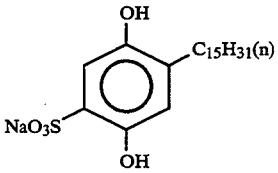
Cpd-I
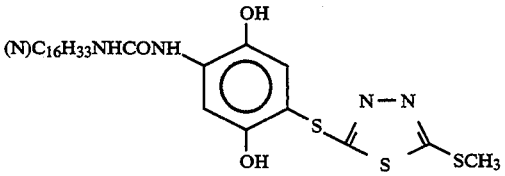
Cpd-J
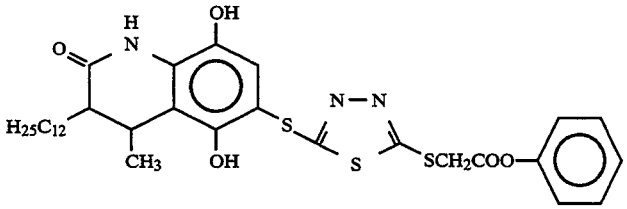
Cpd-K
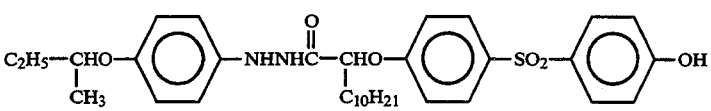
Cpd-L -continued
U-1
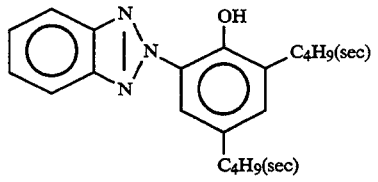
U-2
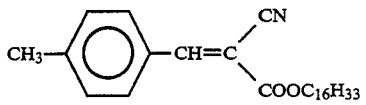
U-3
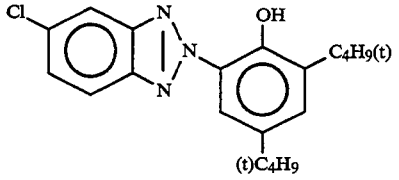
U-4
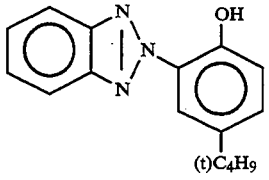
U-5
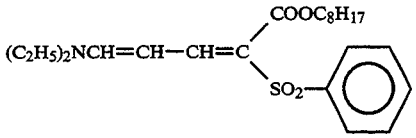
S-1
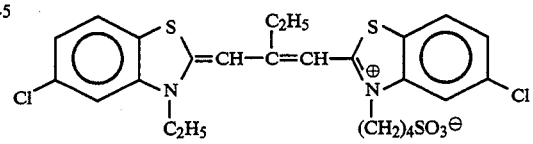
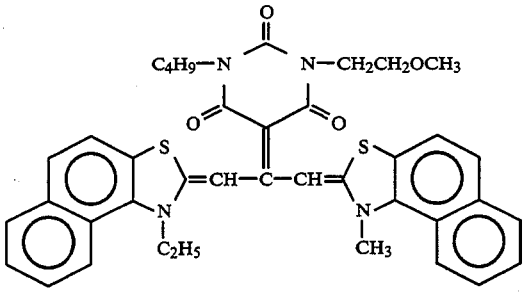
S-2
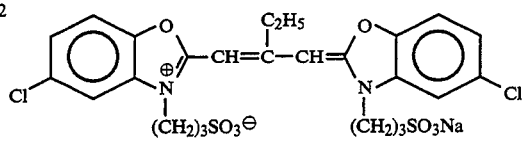
S-3
S-4
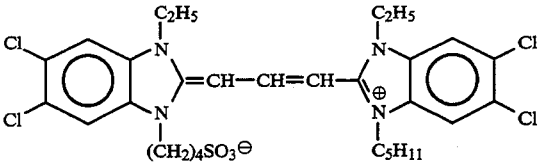
S-5
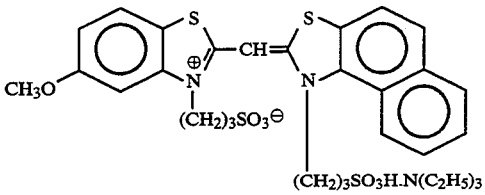
S-6
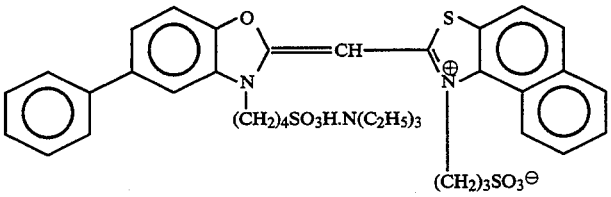
S-7
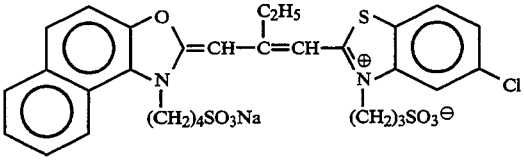
S-8
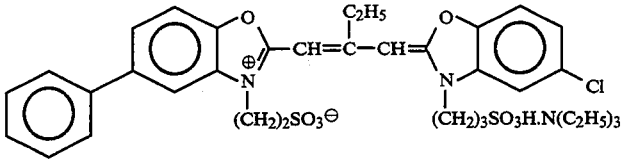

-continued
S-9
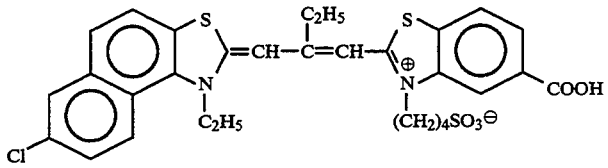
D-1
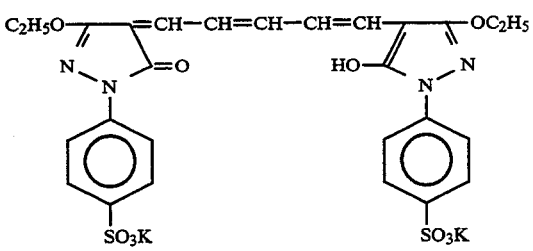
D-2
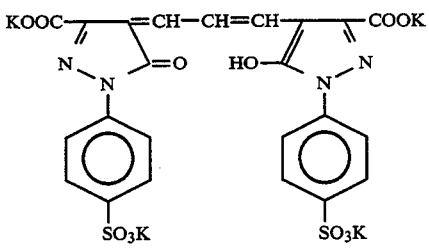
D-3
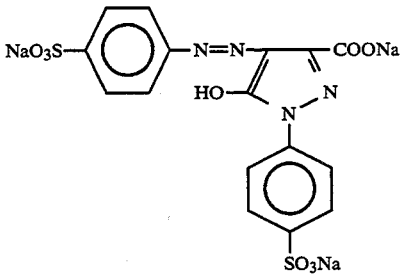
D-4
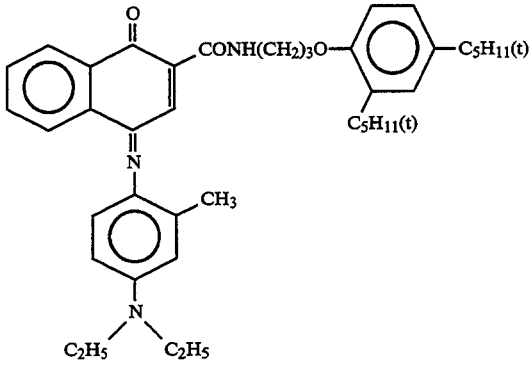
D-5
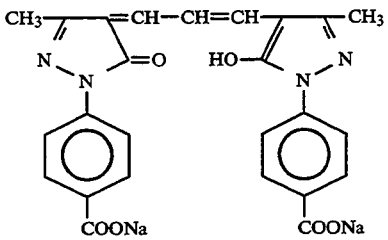
E-1
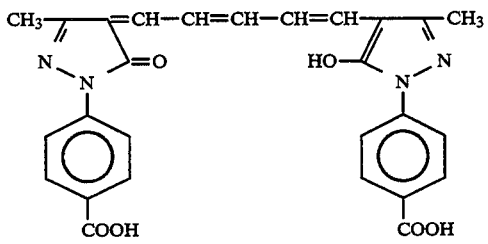
E-2
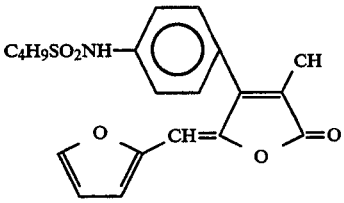
H-1
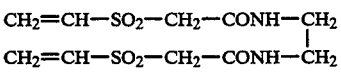

-continued

W-1

$C_8F_{17}SO_2NHCH_2CH_2CH_2OCH_2CH_2\overset{\oplus}{N}(CH_3)_3$

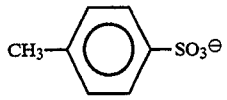

W-2

$C_8F_{17}SO_2N(C_3H_7)CH_2COOK$

W-3

$NaO_3S-CH(CH_2COOCH_2CH(C_2H_5)C_4H_9)COOCH_2CH(C_2H_5)C_4H_9$

W-4

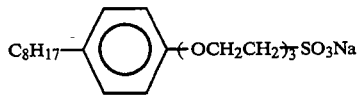

W-5

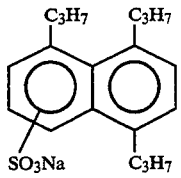

W-6

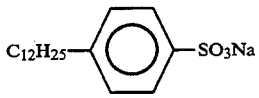

P-1

$-(CH_2-CH(CONHC_4H_9(t))-)_n-$

M-1

$-(CH_2-CH(COOC_4H_9)-)_n-$

F-1

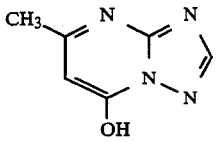

F-2

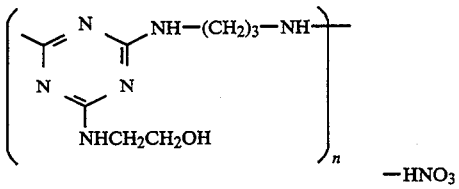

F-3

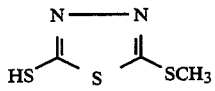

F-4

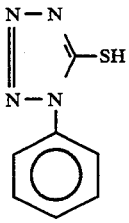

F-5

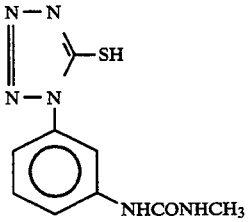

F-6

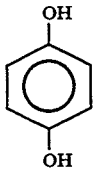

F-7

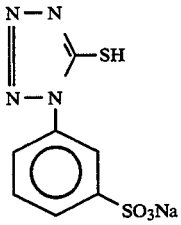

F-8

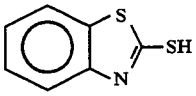

Making of Samples 202–221

Samples 202 to 221 were made following the same procedures as for the sample 201 except that the emulsion Em-1 in the sixth layer was replaced with the emulsions Em-2 to Em-21 used in Example 1, respectively.

After the coating, the sample pieces thus obtained were subjected to film hardening at a temperature of 30° C. and a relative humidity of 60% for 14 days. The resultant samples were stored in a freezer or forcibly degraded at a temperature of 60° C. and a relative humidity of 80% for three days. The samples thus processed were subjected to white exposure through a gray wedge for a exposure time of 1/100 second and processed by the following method (color reversal development). Thereafter, sensitometry was performed for these samples.

The relative sensitivity of each sample is represented by a relative value assuming that the reciprocal of an exposure amount required for the sample 201 to give a density of 2.0 is 100.

The increase in fog appears in the form of a reduction in maximum density when the reversal processing of this example is performed. For this reason, the comparison between the values of fog of the samples 201 to 221 was performed by comparing the respective maximum densities of these samples. That is, the storage stability is evaluated by the value obtained by subtracting the maximum density of the sample stored in a freezer from that of the sample forcibly degraded.

The results are summarized in Table 5 below.

TABLE 5

| Sample No. | Chemical sensitization | Selenium compound | Sensitizing dye | Relative sensitivity | Change in maximum density with time*) |
|---|---|---|---|---|---|
| 201 Comparative Example | Gold-sulfur | — | S-1,S-2, S-7 | 100 | −0.20 |
| 202 Comparative Example | Gold-sulfur | — | S-9,S-2, S-7 | 100 | −0.30 |
| 203 Comparative Example | Gold-sulfur | — | I-1,S-2, S-7 | 102 | −0.05 |
| 204 Comparative Example | Gold-sulfur | — | I-4,S-2, S-7 | 101 | −0.04 |
| 205 Comparative Example | Gold-sulfur | — | I-12,S-2, S-7 | 100 | −0.10 |
| 206 Comparative Example | Gold-selenium | Exemplified compound 1 | S-1,S-2, S-7 | 132 | −1.42 |
| 207 Comparative Example | Gold-selenium | Exemplified compound 1 | S-9,S-2, S-7 | 131 | −1.61 |
| 208 Invention | Gold-selenium | Exemplified compound 1 | I-1,S-2, S-7 | 132 | −0.30 |
| 209 Invention | Gold-selenium | Exemplified compound 1 | I-4,S-2, S-7 | 131 | −0.31 |
| 210 Invention | Gold-selenium | Exemplified compound 1 | I-12,S-2, S-7 | 130 | −0.34 |
| 211 Comparative Example | Gold-sulfur-selenium | Exemplified compound 1 | S-1,S-2, S-7 | 125 | −0.66 |
| 212 Comparative Example | Gold-sulfur-selenium | Exemplified compound 1 | S-9,S-2, S-7 | 126 | −0.82 |
| 213 Invention | Gold-sulfur-selenium | Exemplified compound 1 | I-1,S-2, S-7 | 126 | −0.19 |
| 214 Invention | Gold-sulfur-selenium | Exemplified compound 1 | I-4,S-2, S-7 | 126 | −0.24 |
| 215 Invention | Gold-sulfur-selenium | Exemplified compound 1 | I-12,S-2, S-7 | 126 | −0.28 |
| 216 Invention | Gold-sulfur-selenium | Exemplified compound 16 | I-1,S-2, S-7 | 125 | −0.30 |
| 217 Invention | Gold-sulfur-selenium | Exemplified compound 19 | I-1,S-2, S-7 | 125 | −0.26 |
| 218 Invention | Gold-sulfur-selenium | Exemplified compound 21 | I-1,S-2, S-7 | 127 | −0.15 |
| 219 Invention | Gold-sulfur-selenium | Exemplified compound 33 | I-1,S-2, S-7 | 126 | −0.20 |
| 220 Invention | Gold-sulfur-selenium | Exemplified compound 37 | I-1,S-2, S-7 | 124 | −0.29 |
| 221 Invention | Gold-sulfur-selenium | Exemplified compound 41 | I-1,S-2, S-7 | 127 | −0.16 |

*)The value obtained by subtracting the maximum density of the sample stored in a freezer from that of the sample stored at a temperature of 60° C. and a relative humidity of 80% for three days.

| Processing Method | | | | |
|---|---|---|---|---|
| Process | Time | Temperature | Tank volume | Quantity of replenisher |
| Black-and-white development | 6 min. | 38° C. | 12 l | 2.2 l/m$^2$ |
| 1st washing | 2 min. | 38° C. | 4 l | 7.5 l/m$^2$ |
| Reversal | 2 min. | 38° C. | 4 l | 1.1 l/m$^2$ |
| Color development | 6 min. | 38° C. | 12 l | 2.2 l/m$^2$ |
| Control | 2 min. | 38° C. | 4 l | 1.1 l/m$^2$ |
| Bleaching | 6 min. | 38° C. | 12 l | 0.22 l/m$^2$ |
| Fixing | 4 min. | 38° C. | 8 l | 1.1 l/m$^2$ |
| 2nd washing | 4 min. | 38° C. | 8 l | 7.5 l/m$^2$ |
| Stabilization | 1 min. | 25° C. | 2 l | 1.1 l/m$^2$ |

The compositions of the processing solutions were as follows.

| Black-and-white developing solution | | |
|---|---|---|
| | Tank solution | Replenisher |
| Nitrilo-N,N,N-trimethylenephosphonic acid.pentasodium salt | 2.0 g | 2.0 g |
| Sodium sulfite | 30 g | 30 g |
| Hydroquinoneypotassium monosulfonate | 20 g | 20 g |
| Potassium carbonate | 33 g | 33 g |
| 1-phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH | 9.60 | 9.60 |

The pH was controlled by hydrochloric acid or potassium hydroxide.

| Reversal solution | | |
|---|---|---|
| | Tank solution | Replenisher the same as tank solution |
| Nitrilo-N,N,N-trimethylenephosphonic acid.pentasodium salt | 3.0 g | |
| Stannous chlorideydih.drate | 1.0 g | |
| p-aminophenol | 0.1 g | |
| Sodium hydroxide | 8 g | |
| Glacial acetic acid | 15 ml | |
| Water to make | 1,000 ml | |
| pH | 6.00 | |

The pH was controlled by hydrochloric acid or sodium hydroxide.

| Color developing solution | Tank solution | Replenisher |
|---|---|---|
| Nitrilo-N,N,N-trimethylenephosphonic acid.pentasodium salt | 2.0 g | 2.0 g |
| Sodium sulfite | 7.0 g | 7.0 g |
| Trisodium phosphate.dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4-aminoaniline sulfuric acid | 11 g | 11 g |
| 3,6-dithia-1,8-octanediol | 1.0 g | 1.0 g |
| Water to make | 1,000 ml | 1,000 ml |
| pH | 11.80 | 12.00 |

The pH was controlled by hydrochloric acid or potassium hydroxide.

| Control solution | Tank solution | Replenisher the same as tank solution |
|---|---|---|
| Ethylenediaminetetraacetic acidydisodium salt.dihydrate | 8.0 g | |
| Sodium sulfite | 12 g | |
| 1-thioglycerine | 0.4 ml | |
| Sorbitan ester given below | 0.1 g | |

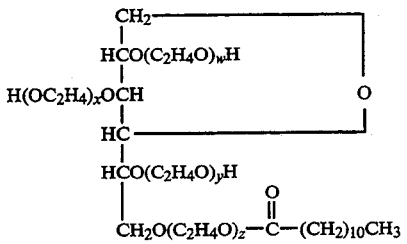

(w + x + y + z = 20)

| | | |
|---|---|---|
| Water to make | 1,000 ml | |
| pH | 6.20 | |

The pH was controlled by hydrochloric acid or sodium hydroxide.

| Bleaching solution | Tank solution | Replenisher |
|---|---|---|
| Ethylenediaminetetraacetic acidydisodium salt.dihydrate | 2.0 g | 4.0 g |
| Ethylenediaminetetraacetic acidyFe(III)-yammoniumy dih.drate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |

| Fixing solution | Tank solution | Replenisher the same as tank solution |
|---|---|---|
| Ammonium thiosulfate | 80 g | |
| Sodium sulfite | 5.0 g | |
| Sodium bisulfite | 5.0 g | |
| Water to make | 1,000 ml | |

-continued

| Fixing solution | Tank solution | Replenisher the same as tank solution |
|---|---|---|
| pH | 6.60 | |

The pH was controlled by hydrochloric acid or ammonia water.

| Stabilizing solution | Tank solution | Replenisher the same as tank solution |
|---|---|---|
| Formalin (37%) | 5.0 ml | |
| Polyoxyethylene-p-monononylphenyl ether (average polymerization degree 10) | 0.5 ml | |
| Water to make | 1,000 ml | |
| pH | Not controlled | |

As can be seen from Table 5, in the emulsions using the sensitizing dyes S-1 and S-9, although high sensitivities were achieved by changing the chemical sensitization from gold-sulfur sensitization to gold-selenium sensitization and to gold-sulfur-selenium sensitization, this was accompanied by the unpreferable result that the maximum densities decreased significantly with time. In the emulsions subjected to the gold-sulfur sensitization, the decreases in maximum density with time were suppressed by using the sensitizing dyes I-1, I-4 and 1-12 of the present invention in place of the sensitizing dye S-1 or S-9, but no high enough sensitivity could be obtained in that case. The preferable results such as sufficiently high sensitivities and relatively low increases in fog with time were not able to be obtained unless the present invention were used.

According to the present invention as has been described above, there is provided a high-sensitivity silver halide photographic light-sensitive material capable of suppressing fog during storage and having a high storage stability in maximum density.

What is claimed is:

1. A silver halide photographic light-sensitive material having at least one silver halide emulsion layer on a support, wherein at least one of said silver halide emulsion layers comprises an emulsion subjected to chemical sensitization with a selenium compound represented by Formula (B) below:

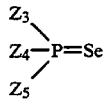

Formula (B)

wherein $Z_3$, $Z_4$ and $Z_5$ each represent an aliphatic group, an aromatic group or —$OR_7$, and $R_7$ represents an aliphatic group or an aromatic group, and said emulsion is subjected to spectral sensitization with at least one type of a methine compound represented by Formula (I) below:

Formula (I)

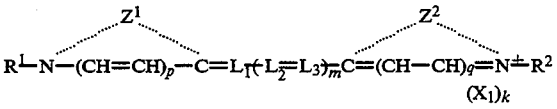

wherein $R^1$ represents $-(CH_2)_r-CONHSO_2-R^3$, $-(CH_2)_s-SO_2NHCO-R^4$, $-(CH_2)_t-CONHCO-R^5$, or $-(CH_2)_u-SO_2-NHSO_2-R^6$ wherein $R^3$, $R^4$, $R^5$, and $R^6$ each represent an alkyl group, an alkoxy group, or an amino group, r, s, t, and u each represent an integer from 1 to 5, $R^2$ has the same meaning as $R^1$ or represents an alkyl group, $Z^1$ and $Z^2$ each represent a nonmetalic atom group required to form a benzothiazole, p and q each represent 0 or 1, $L_1$, $L_2$, and $L_3$ each represent a methine group, m represents 0, 1, or 2, $X_1$ represents anion, and k represents a number required to adjust the charge in the molecule to 0.

2. The silver halide photographic light-sensitive material according to claim 1, wherein $R^1$ represents $-(CH_2)_r-CONHSO_2-R^3$.

3. The silver halide photographic light-sensitive material according to claim 1, wherein $R^1$ represents $-(CH_2)_s-SO_2NHCO-R^4$.

4. The silver halide photographic light-sensitive material according to claim 1, wherein $R^1$ represents $-(CH_2)_t-CONHCO-R^5$.

5. The silver halide photographic light-sensitive material according to claim 1, wherein $R^1$ represents $-(CH_2)_u-SO_2NHSO_2-R^6$.

6. The silver halide photographic light-sensitive material according to claim 1, wherein at least one of $L_1$, $L_2$ and $L_3$ represents a methine group substituted by an ethyl group.

7. The silver halide photographic light-sensitive material according to claim 1, wherein a sulfur sensitizer and/or a gold sensitizer are used in combination with the selenium compound during said chemical sensitization.

* * * * *